US005253801A

United States Patent [19]

Bernstein et al.

[11] Patent Number: 5,253,801

[45] Date of Patent: Oct. 19, 1993

[54] MULTI SIDED FOOD TRAY

[75] Inventors: Linda A. Bernstein, Campbell Hall; Robert L. Gordon, Monroe, both of N.Y.; Tung C. Ma, Fort Lee, N.J.; Robert Sosnowksi, Monroe, N.Y.

[73] Assignee: International Paper Company, Purchase, N.Y.

[21] Appl. No.: 995,231

[22] Filed: Dec. 22, 1992

[51] Int. Cl.[5] ..... B65D 5/40; B65D 5/56

[52] U.S. Cl. ..... 229/113; 229/110; 229/123.2; 229/125.35; 229/186

[58] Field of Search ..... 229/2.5 R, 109, 110, 229/123.2, 123.3, 125.35, 186, 113, 114

[56] References Cited

U.S. PATENT DOCUMENTS

| | | | |
|---|---|---|---|
| 726,205 | 4/1903 | Tuttle . | |
| 1,177,410 | 3/1916 | Hatfield | 220/453 |
| 2,239,571 | 4/1941 | Ray | 220/418 |
| 2,241,710 | 5/1941 | Lowey | 220/418 |
| 2,328,563 | 9/1943 | Lichter | 229/3.5 |
| 2,328,798 | 9/1943 | Gardner | 220/463 |
| 2,590,221 | 3/1952 | Stevens | 220/461 |
| 2,617,579 | 11/1952 | Buttery | 220/418 |
| 2,665,616 | 1/1954 | Jungmayr . | |
| 2,736,065 | 2/1956 | Wilcox | 220/462 |
| 2,780,401 | 2/1957 | Stevens | 229/2.5 R |
| 2,856,114 | 10/1958 | Guyer | 220/418 |
| 3,104,012 | 9/1963 | Beamish . | |
| 3,135,455 | 6/1964 | Santagelo . | |
| 3,336,019 | 1/1967 | McGee | 220/462 |
| 3,338,020 | 8/1967 | McGee | 220/460 |
| 3,383,026 | 5/1968 | McGee | 220/462 |
| 3,489,331 | 1/1970 | Andersson | 229/109 |
| 3,575,338 | 4/1971 | Dilot | 220/462 |
| 3,756,495 | 9/1973 | Bemiss | 220/418 |
| 3,779,447 | 12/1973 | Bemiss | 220/462 |
| 3,863,830 | 2/1975 | Christensson . | |
| 3,866,816 | 2/1975 | Bemiss | 220/462 |
| 3,877,630 | 4/1975 | Silver | 220/418 |
| 3,885,730 | 5/1975 | Christensson | 220/450 |
| 3,917,155 | 11/1975 | Bemiss | 229/186 |
| 4,014,496 | 3/1977 | Christensson . | |
| 4,032,060 | 6/1977 | Brgstein | 220/418 |
| 4,056,221 | 11/1977 | Piltz et al. | 220/418 |
| 4,171,064 | 10/1979 | Friess et al. | 220/418 |
| 4,257,530 | 3/1981 | Faller | 220/469 |
| 4,335,830 | 6/1982 | Garganese | 220/462 |
| 4,351,473 | 9/1982 | Manizza | 229/125.35 |
| 4,533,065 | 8/1985 | Chazal et al. | 220/462 |
| 4,779,758 | 10/1988 | Chazal et al. | 220/462 |

FOREIGN PATENT DOCUMENTS

| | | | |
|---|---|---|---|
| 625118 | 6/1949 | United Kingdom | 220/418 |

*Primary Examiner*—Gary E. Elkins
*Attorney, Agent, or Firm*—Michael J. Doyle

[57] ABSTRACT

A flanged tray and preform for making it. The preform includes a cut and scored paperboard blank having a polygonal bottom forming base panel. Each edge of the base is foldably joined to a radially outwardly extending, regular trapezoidal sidewall forming panel. The radially outermost portion of each sidewall panel carries a horizontal flange forming flap. The preform also includes a thin plastic sheet adhered to one surface of the paperboard blank. The plastic sheet covers the blank and extends over radially extending gaps between the side edges of next adjacent sidewall panels. The preform is placed in a female die with the plastic film facing upwardly. A male die presses the preform downwardly to form it into a tray having a peripheral, horizontally extending flange. The step of permanently attaching the plastic film to the paperboard blank may be carried out concurrently with the step of deforming the blank in the die. The plastic film secures the sidewalls together and provides a liquid impervious coating on the tray interior surfaces. The tray may be provided with a paperboard lid having a tear off portion. The tray and lid exhibit utility for the packaging of foods. A layer of polymer barrier film is sealed over the formed tray to provide barriers to oxygen and water vapor. In a modification, integral gussets are provided between next adjacent side edges of the sidewalls.

5 Claims, 3 Drawing Sheets

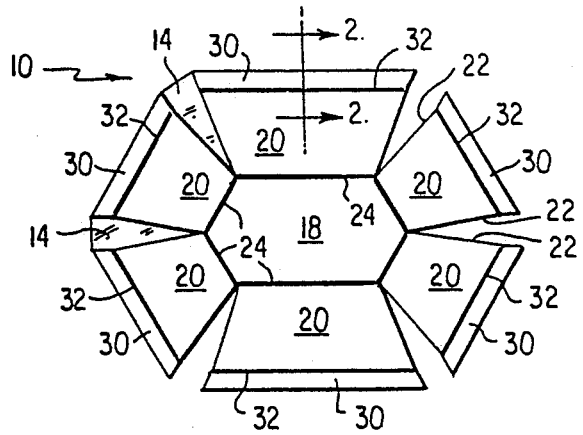
FIG. 1
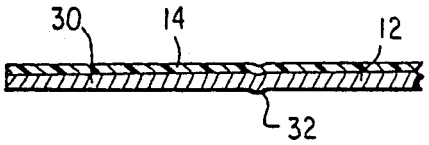
FIG. 2
FIG. 3
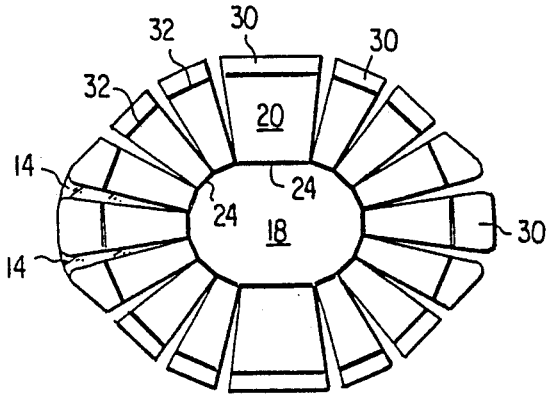
FIG. 4
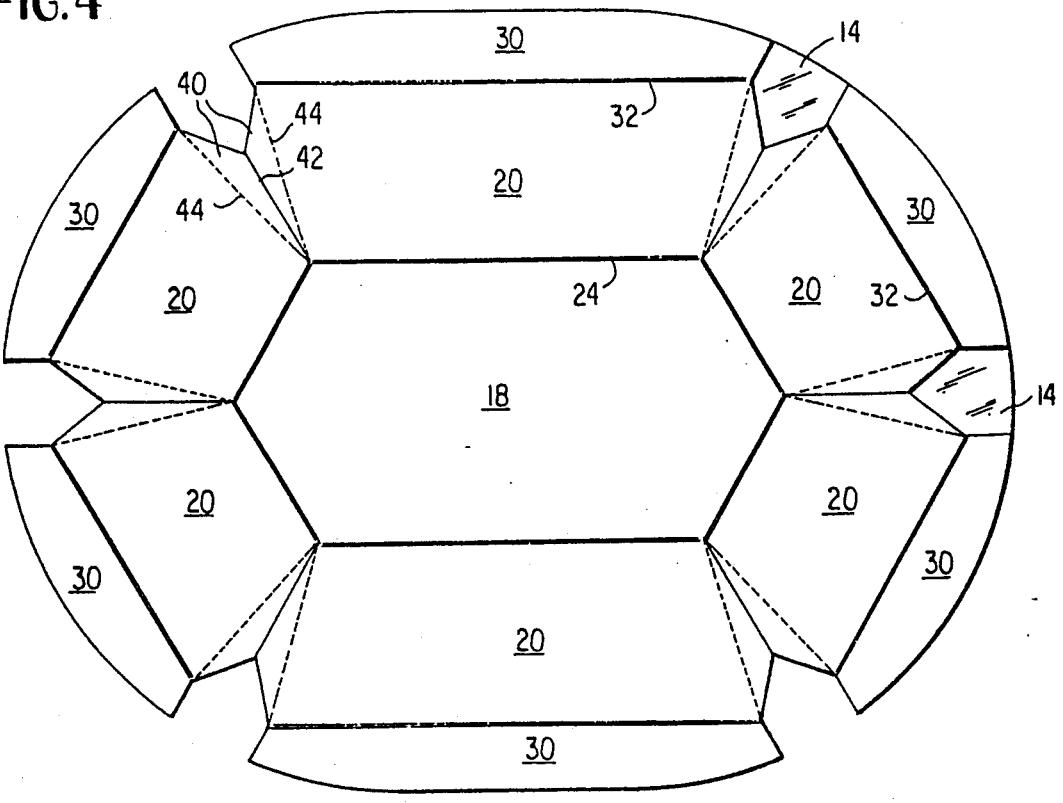

FIG. 8
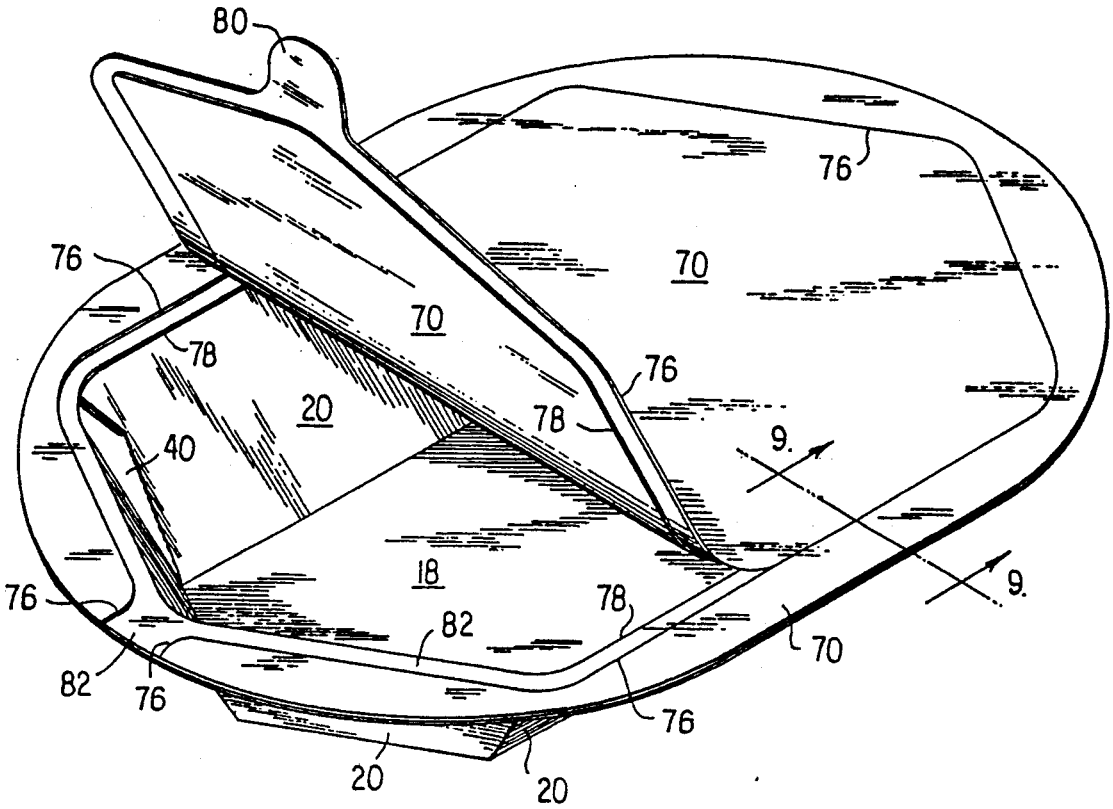
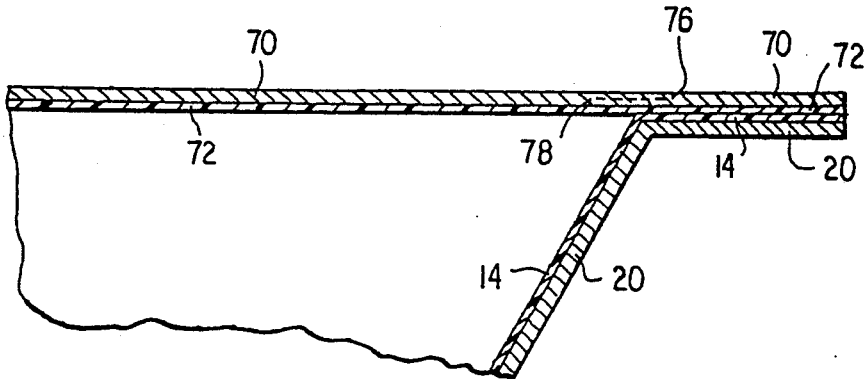
FIG. 9

MULTI SIDED FOOD TRAY

BACKGROUND OF THE INVENTION

This invention relates to the art of packaging and more particularly to a flanged tray and cover therefor. The tray interior is lined with a polymer barrier film. The polymer film enables the tray to be employed for the packaging of foodstuffs, as well as imparting structural rigidity to the tray side walls.

The food packaging industry currently uses polymer coated paperboard which is formed into trays. Such trays have gusseted corners or overlapping corners to make them leak proof. This overlapping gives rise to leak channels on the flange area of the tray. Further, most food trays are four sided (square or rectangular) which does not impart a pleasing shape.

SUMMARY OF THE INVENTION

The food package of this invention includes three components. These are, (1) a unitary paperboard flanged tray blank having a bottom panel and upstanding, gusseted sidewall panels (2) a barrier film or polymer material covering the tray interior surfaces, and (3) a cover or lidding. The paperboard blank forming the tray is typically die cut and scored, the sidewall panels each foldably connected at one of its respective ends to a respective side of the polygonal bottom, the sidewall panels each having a horizontal flange forming flap at their respective remote or free ends. A polymer barrier film is placed over the blank, the blank and film then positioned over a female die for shaping by a male die. The female die is provided with vacuum openings, and a vacuum is applied to the blank and film during shaping of the blank and film in the female mold. During the downward stroke of the male die, the gussets fold over upon themselves and are sealingly covered by the barrier layer material. The film barrier layer closes off the ends of leak channels which may be formed in the overlapped gussets, or the voids between upright panels and also maintains the tray walls and flange in their die pressed configuration. This process allows for the abutment of the uppermost flange edges. This abutment is covered by the polymer film resulting in a continuous flat sealing surface for the tray lid.

BRIEF DESCRIPTION OF THE DRAWINGS

FIG. 1 is a plan view of a paperboard blank for forming the tray of this invention, the blank provided on one surface thereof with a plastic film.

FIG. 2 is a view taken along section 2—2 of FIG. 1.

FIG. 3 is a view similar to FIG. 1 and shows a modification.

FIG. 4 is a view similar to FIG. 1 and shows another modification.

FIG. 8 is a perspective view of a flanged tray of this invention provided with a lid or cover, the cover shown as partially open.

FIG. 9 is a view taken along section 9—9 of FIG. 8.

DETAILED DESCRIPTION OF THE DRAWINGS

Figure 5:
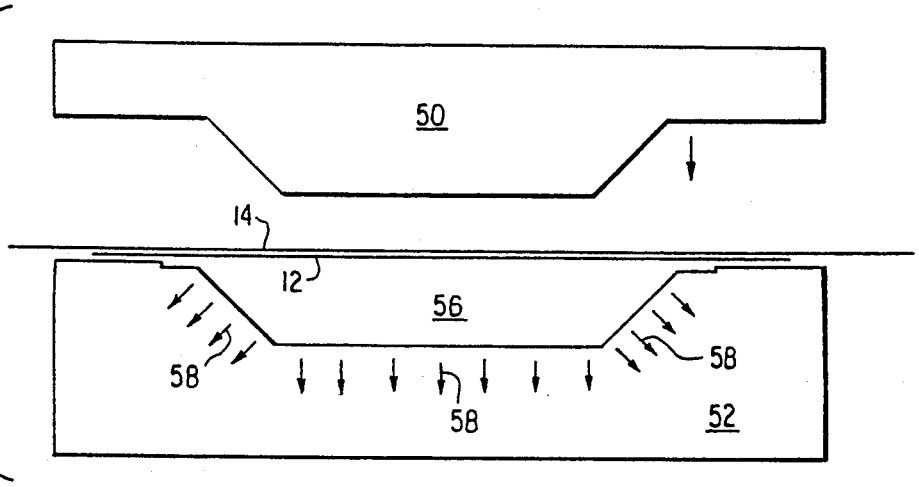
FIGS. 5 to 7 illustrate a method of forming a flanged tray from the blank.

Referring now to FIGS. 1 and 2 of the drawings, a paperboard blank 10 is provided on the interior forming surface thereof with a plastic barrier film or layer. The blank includes a hexagonal bottom panel 18 having fold lines 24 at each side thereof. In turn, each fold line borders the inner ends of respective side forming panels 20, the latter of generally trapezoidal form. The radially outermost edge of each side panel 20 includes a flap 30 secured to its respective side panel 20 along a fold line 32. As also shown at FIG. 2, the upper surface of paperboard 12 from which the blank is formed is provided with a polymer barrier layer or film 14, layer 14 covering all of one surface of the blank and also spanning all of the gaps between the radially extending free edges of side wall panels 20 and flaps 30. Only two of the gaps are shown as spanned by film 14.

FIG. 3 is a view similar to FIG. 1 and illustrates a different form of the paperboard blank and its plastic barrier layer 14. There, the polygonal base 18 has sixteen sides, with a corresponding number of trapezoidal side wall forming panels 20 and accompanying flange forming flaps 30. Again, fold lines 32 connect flaps 30 with side walls 20, while fold lines 24 are located at the integral connections between central panel or base 18 and side wall forming panels 20. Only two of the gaps are shown as spanned by film 14, although in practice all of them are spanned.

Referring now to FIG. 4 of the drawings, a different hexagonal paperboard blank 12 and associated plastic barrier layer film 14 secured to its inner tray forming surface is shown. Again, the blank includes side wall panels 20 of generally trapezoidal form, and radially outermost flanges 30 integrally coupled through fold lines 32 to respective side wall panels 30. Integral gussets 40, also formed from paperboard 12, extend between the radially extending edges of side walls 20, each gusset including a central fold line 42 at fold lines 44 indicated by dashed lines, and a V-shaped recess. When the flat blank is bent for final assembly, as will shortly be explained, gussets 40 overlap each other and rest on the inside surface of the completed tray sidewalls. Only two of the gaps are shown as spanned by film 14, although in practice all of them are spanned.

Figure 6:
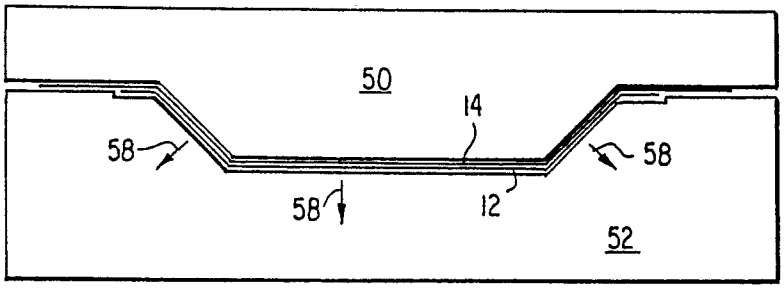
Figure 7:
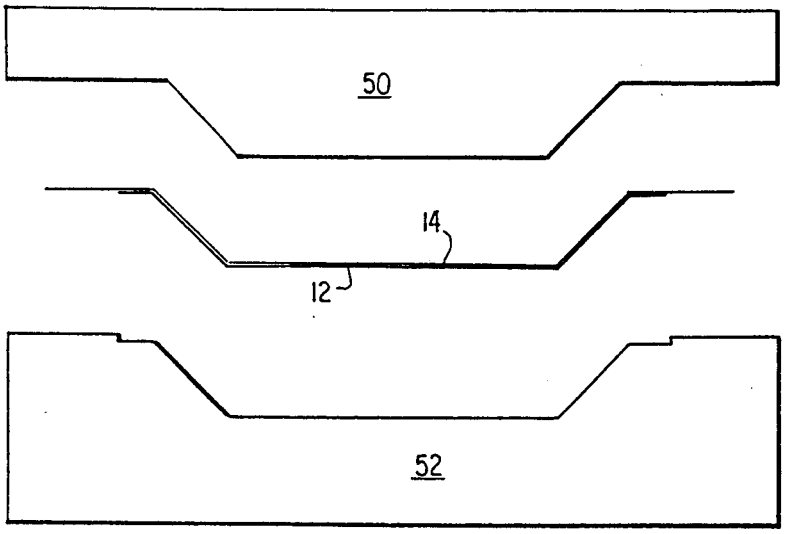

Referring now to FIGS. 5 to 7 of the drawings, a method of forming the tray of this invention from any of the blanks previously described is illustrated. Referring firstly to FIG. 5, a male die 50 and a female die 52, both usually of metal, are shown, with female die 52 having a mold cavity 56 and vacuum ports schematically indicated as 58. The vacuum ports terminate at the surface of cavity 56. Paperboard substrate 12 and plastic barrier layer 14 are placed as indicated at FIG. 5. Then, as shown at FIG. 6, the male die is pushed downwardly so as to engage and clamp the laminate defined by layers 12 and 14. One or both of the dies 50, 52 may be heated, as well as the polymer barrier layer 14. This polymer layer has been prelaminated to the pre-diecut paperboard blank. The blank and polymer layer are forced down inside the female cavity by the male mandrel, with the recess defined by the two dies 50 and 52 when fully closed being of the same size as the finished tray, less the blank and polymer thickness. The combination of the die pressure, vacuum applied through ports 58 when the two dies mesh, and heat causes the polymer film to adhere and become laminated to the now formed paperboard tray. This adhesion between the two components 12 and 14 produces a multi-sided, three dimensional tray. The paperboard blank may additionally be coated, with a polymer which is seal compatible with film polymer 14. It will be understood that a tray formed from any of the blanks or preforms of FIGS. 1, 3, and 4 may be formed using the process and apparatus illustrated at FIGS. 5 to 7.

If a tray is made from the gusseted blank of FIG. 4, gussets 40 fold about lines 44 and the gusset halves fold onto themselves about respective lines 42, the folded gussets lying essentially parallel against a respective sidewall 20, with barrier layer film 14 covering the ends of any leak channels in the several gussets. The use of the barrier film 14 serves the dual function of strengthening the tray walls so they will remain in their desired relative positions, and seal the ends of weep or leak channels which may form in the folded gussets.

FIG. 7 shows the completed tray as the upper die 50 is removed and the tray removed from the lower die.

Referring now to FIGS. 8 and 9, a food package formed from a tray made from the blank of FIG. 4 and a lidding or cover are illustrated. The lidding is defined by a paperboard blank 70 of generally oval form, its periphery corresponding to that defined by the peripheries of abutting flanges 30 of FIG. 4. A polymer barrier layer or film 72 is located on the underside of blank 70 to define a lidding 70, 72. An annularly continuous peripheral cut 76 is made from the top of blank 70 down to half of its thickness, while a similar peripheral cut 78 is made from the lower portion of the blank and extends upwardly half way through paperboard 70. The periphery of lidding 70, 72 is secured to the barrier layer coated tray flanges 30 by heat and pressure to thus fuse barrier layers 72 and 14. The package contents are thus completely sealed by barrier layers 14 and 72, protecting the contents from ambient oxygen and water vapor. Pull tab 80 extends from one rim portion of the lidding and beyond the tray edge. Cuts 76 extend to the outer periphery of the flanges 30 of the package in the area of pull tab 80 and surround it. In some cases, upper barrier film 72 may not be needed, the paperboard merely printed for graphics and die cut as described.

When the contents of the package are ready for consumption, the user pulls the pull tab 80 upwardly, thereby ripping the lidding along spaced, reverse cuts 76 and 78. Paperboard 70 tears between these reverse cuts to define a recess 82, and after tearing off or ripping the surface of 82 is somewhat rough, having been separated by the tearing. After tearing away paperboard 70 the film 72 is exposed. The consumer cuts this film with a sharp implement and removes it to gain access to the product. If the film is left on during heating of the food, it must be punctured to vent steam.

The barrier layer 14 is a polymer film which can be any type of heat formable plastic in single or multiple layers. Its thickness will vary from 2 mils to 8 mils. The preferred polymers for liquid products are coextruded polyethylene (PE) films. For microwave application, polypropylene is used. For dual ovenable (microwave and conventional ovens) polyester is preferred. For modified atmospheric packaging/controlled atmosphere packaging (MAP/CAP) packages various laminates, i.e., nylon, ethylene vinyl alcohol (EVOH), low density polyethylene (LDPE) can be used. All of the above can be used as with laminate adhesives such as ethylene vinyl acetate (EVA), ethylene acrylic acid (EAA) and polyvinyl acetate (PVAC).

We claim:

1. A preform for forming a flanged tray, the preform including a unitary blank of paperboard and a unitary plastic seat affixed to one surface of said paperboard blank, said paperboard blank having cut and score lines, said score lines defining a central polygonal bottom panel having edges, each said polygonal bottom edge foldably connected to one edge of a radially outwardly extending trapezoidal sidewall forming panel, each said trapezoidal panel having a radially outermost portion, the radially outermost portion of each said sidewall panel foldably connected to a flange forming flap, each said sidewall panel having a pair of side edges which taper away from each other with increasing radial distance from said polygonal bottom to thereby define a gap between respective said side edges of next adjacent said sidewall panels, said plastic sheet extending over the entire said one surface of said preform and extending radially outwardly from said polygonal bottom and covering said gaps.

2. The preform of claim 1 wherein a portion of the side edges of next adjacent said sidewall panels are foldably connected by a gusset panel.

3. The preform of claim 1, wherein each said flange forming flap has a radially outermost, free edge which is arcuate.

4. The preform of claim 1 wherein each said flange forming flap has a radially outermost, free edge which is straight.

5. A tray formed of a unitary paperboard blank and a plastic film covering one surface of the blank, the tray having a polygonal bottom panel having edges, each respective edge of said bottom panel foldably joined to a respective trapezoidal sidewall panel, each said sidewall panel folded upwardly from said base, each said sidewall panel having an upper horizontal flange extending radially outwardly, said bottom panel and sidewall panels having inner surfaces, each upper horizontal flange having a top, said plastic film adhered to the inner surfaces of said bottom panel and said sidewall panels and to the top of said horizontal flanges, and wherein edges of said sidewall panels are at least partially integrally connected by a respective folded gusset, to define a plurality of gussets, said gussets each lying substantially parallel to and on the inner surface of a respective sidewall panel, said film covering said gussets.

* * * * *